US006361455B1

(12) United States Patent
Takemura

(10) Patent No.: US 6,361,455 B1
(45) Date of Patent: Mar. 26, 2002

(54) GOLF BALL

(75) Inventor: Kohei Takemura, Nara (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/592,932

(22) Filed: Jun. 13, 2000

(30) Foreign Application Priority Data

Jun. 14, 1999 (JP) ..... 11-166547

(51) Int. Cl.[7] ..... A63B 37/12; A63B 37/14; A63B 37/00; A63B 37/06

(52) U.S. Cl. ..... 473/378; 473/351; 473/365

(58) Field of Search ..... 473/351, 356, 473/361, 378, 359, 366, 367, 368, 370, 371, 372, 373, 374, 377

(56) References Cited

U.S. PATENT DOCUMENTS 5,262,468 A * 11/1993 Chen ..... 524/476
5,586,950 A * 12/1996 Endo ..... 473/356
5,711,723 A * 1/1998 Hiraoka et al. ..... 473/374
5,725,442 A * 3/1998 Higuchi et al. ..... 473/376
5,730,663 A * 3/1998 Tanaka et al. ..... 473/373
5,733,205 A * 3/1998 Higuchi et al. ..... 473/376
5,795,247 A * 8/1998 Yokota et al. ..... 473/374
5,816,943 A * 10/1998 Masutani et al. ..... 473/365
5,824,740 A * 10/1998 Yabuki et al. ..... 525/71
5,824,747 A * 10/1998 Yokota ..... 525/221
5,836,832 A * 11/1998 Boehm et al. ..... 473/354
5,908,358 A * 6/1999 Wu ..... 473/378
5,980,395 A * 11/1999 Tsunoda et al. ..... 473/373
5,994,470 A * 11/1999 Tanaka et al. ..... 525/193
6,120,393 A * 9/2000 Sullivan et al. ..... 473/377
6,142,887 A * 11/2000 Sullivan et al. ..... 473/374
6,149,535 A * 11/2000 Bissonnette et al. ..... 473/354
6,150,462 A * 11/2000 Rajagopalan et al. ..... 525/74
6,152,836 A * 11/2000 Bradley et al. ..... 473/378

OTHER PUBLICATIONS

Efunda Engineering Fundamentals. (www.efunda.com).*
Callister, Jr., William D., Materials Science and Engineering: An Introduction, 4th Edition. New York: John Wiley and Sons, Inc., Copyright 1997, pp. 778,780.*
Efunda Engineering Fundamentals, copyright 2001 (www.e-funda.com).*

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

A golf ball having excellent resistance to a flyer type golf shot normally produced when a golf shot is executed from the rough, and also having excellent cut resistance and high rebound characteristics, wherein the golf ball cover has a shear modulus (G) of 3 to 100 MPa, a Young's modulus (E) of 9 to 400 MPa, and a ratio (E/G) of 2.4 to 3.0.

25 Claims, No Drawings

GOLF BALL

FIELD OF THE INVENTION

The present invention relates to a golf ball having excellent spin performance. More particularly, it relates to a golf ball having excellent flyer resistance when executing a shot out of the rough, as well as possessing excellent cut resistance and high rebound characteristics.

BACKGROUND OF THE INVENTION

Solid golf balls, such as a two-piece golf ball or a three-piece golf ball, and thread wound golf balls have been used for rounds of golf. The solid golf ball consists of a solid core of integrally molded rubber material comprising polybutadiene as a main component and a cover of thermoplastic resin (e.g. ionomer resin) covering on the solid core. The thread wound golf ball consists of a solid or liquid center, a thread rubber layer formed by winding thread rubber in a stretched state around the center, and a cover of ionomer resin or balata etc. covering the thread wound layer.

The golf ball is often hit in tall grass or rough during normal play. When hit from the rough, a phenomenon called a flyer often occurs, that is, the amount of backspin is small and the ball trajectory is high due to the presence of grass between the golf club face and the golf ball when hitting from the rough. This phenomenon is one of the reasons why it is difficult to control approach shots. The phenomenon occurs regardless of whether a solid golf ball or a thread wound golf ball is utilized, and many golf players are troubled by such a phenomenon.

It has been apparent from studying golf balls utilizing every type of cover that the flyer occurs more frequently when hitting the golf ball using an ionomer resin cover as compared to using a balata cover. The ionomer resin cover has a high elastic modulus and excellent rebound characteristics, but the resulting golf ball formed by the cover has a small spin amount and poor controllability.

On the other hand, in case of a golf ball using a balata cover, although a flyer is less likely to occur and the controllability of the spin is excellent, the rebound characteristics of the cover material and the cut resistance is poor.

OBJECTS OF THE INVENTION

A main object of the present invention is to provide a golf ball having excellent spin performance and excellent flyer resistance while executing a golf shot from the rough and also having excellent cut resistance and high rebound characteristics.

According to the present invention, the object described above has been accomplished by adjusting the shear modulus (G), the Young's modulus (E) and the ratio of E/G to within specified ranges, thereby providing a golf ball having excellent spin performance and excellent flyer resistance when executing a golf shot from the rough and also having excellent cut resistance and high rebound characteristics.

SUMMARY OF THE INVENTION

The present invention provides a golf ball comprising a core and a cover covering the core, wherein the cover has a shear modulus (G) of 3 to 100 MPa, a Young's modulus (E) of 9 to 400 MPa, and a ratio (E/G) of 2.4 to 3.0.

The present inventors have studied the reason why the flyer shot occurs and have found that the spin amount is sufficiently maintained and the flyer shot is less likely to occur as a relation between the shear modulus (G) and a Young's modulus (E) of the cover of the golf ball is close to the formula:

$$E=3G$$

The statement of E=3G, which is generally known, shows that a polymer chain has a three-dimensional network structure because it has a crosslink or bond similar thereto.

The ionomer resin, which has been typically used of the cover of the golf ball, does not have a chemical, three-dimensional network structure and the value of E/G is less than 2.4 in most cases. It has been shown that an ionomer resin experiences difficulty in recovering its original shape because the elastic modulus in the direction of shearing stress is small, and plastic deformation occurs by applying an outer force in this direction. If the value E/G is smaller than 2.4 at the time of hitting of the golf ball, that is, when the shearing stress is applied to the golf ball, the spin amount is small and a flyer type golf shot is likely to occur.

On the other hand, if the cover material has a chemical three-dimensional network structure, the plastic deformation does not occur by deforming in the direction of the shearing stress and it generally recovers its original shape. Therefore when the relationship between E and G is close to the formula: E=3G, the spin amount is large and the possibility of a flyer type shot is substantially reduced. In addition, since the cover material is crosslinked, the cut resistance is excellent.

There is a cover material, which has suspected crosslinking portion (a frozen phase or crystalline phase), shows the behavior as it is three-dimensionally crosslinked and has the E/G value of not less than 2.4, in thermoplastic resin other than rubber or thermosetting resin.

DETAILED DESCRIPTION OF THE INVENTION

The golf ball of the present invention is composed of a core and a cover formed on the core. The golf ball of the present invention may be either solid golf ball such as two-piece solid golf ball or thread wound golf ball. The core for solid golf ball (solid core) may be the same one that has been conventionally used, and may be obtained by mixing a rubber composition using a mixer such as a mixing roll, and then vulcanizing (crosslinking) or press-molding the rubber composition in a given mold into a spherical form. The rubber composition comprises 10 to 60 parts by weight of a vulcanizing agent (crosslinking agent), for example, ($\alpha$, $\beta$-unsaturated carboxylic acid (such as acrylic acid, methacrylic acid, etc.) or a metal salt thereof, or a functional monomer such as trimethylolpropane trimethacrylate, or a combination thereof; 0.5 to 5 parts by weight of organic peroxides such as dicumyl peroxide, etc.; 10 to 30 parts by weight of filler such as zinc oxide, barium sulfate and the like; optionally antioxidant, based on 100 parts by weight of a base rubber such as polybutadiene. The vulcanization may be conducted, for example, by press molding in a mold at 140 to 170° C. for 10 to 40 minutes.

The core for thread wound golf ball (thread wound core) comprises a center and a thread rubber layer formed by winding thread rubber in a stretched state around the center, wherein the center may be either liquid center or solid center formed from rubber composition. The thread rubber can be the same one that has been conventionally used for the thread rubber layer of the thread wound golf ball. For example, the thread rubber can be obtained by vulcanizing a rubber composition prepared by formulating sulfur, a vulcanization aid, a vulcanization accelerator, an antioxidant and the like to a natural rubber or a blend rubber of the natural rubber and a synthetic polyisoprene. The examples of solid core and thread wound core are only for purpose of illustration, and are not to be construed to limit thereto.

In the golf ball of the present invention, the core has a diameter of 34.8 to 41.8 mm, preferably 36.0 to 41.0 mm. When the diameter of the core is smaller than 34.8 mm, the cover is too thick, and the volume content of the cover is large and the rebound characteristics are degraded. On the other hand, when the diameter of the center is larger than 41.8 mm, the cover is too thin, and the durability is degraded.

The cover is then covered on the core. It is required that the cover of the golf ball of the present invention have a Young's modulus (E) of 9 to 400 MPa, a shear modulus (G) of 3 to 100 MPa and a ratio (E/G) of 2.4 to 3.0.

It is desired that the Young's modulus (E) of the cover have the lower limit of preferably not less than 20 MPa, more preferably not less than 40 MPa, most preferably not less than 50 MPa. It is desired that the Young's modulus (E) of the cover have the upper limit of preferably not more than 300 MPa, more preferably not more than 270 MPa. It is desired that the shear modulus (G) of the cover have the lower limit of preferably not less than 20 MPa, more preferably not less than 40 MPa. It is desired that the shear modulus (G) of the cover have the upper limit of preferably not more than 90 MPa, more preferably not more than 85 MPa. When the Young's modulus (E) is smaller than 9 MPa or the shear modulus (G) is smaller than 3 MPa, the cover is too soft, and the rebound characteristics are degraded and the cut resistance is degraded. On the other hand, when the Young's (E) is larger than 400 MPa or the shear modulus (G) is larger than 100 MPa, the cover is too hard, and the shot feel is poor and the spin amount is small. It is desired that the ratio (E/G) of the cover have the lower limit of preferably not less than 2.7, more preferably not less than 2.8, most preferably not less than 2.9. When the ratio (E/G) is smaller than 2.4, the spin amount is small, and the flyer type shot move easily occurs. The Young's modulus (E) and the shear modulus (G) are generally represented by the following formula:

$$E/G=2(1+\mu)$$

wherein $\mu$ is Poisson's ration. The upper limit of the Poisson's ratio is 0.5, and the upper limit of (E/G) is theoretically 3.0.

The cover may have a single layer structure or multi-layer structure, which has two or more layers. The materials suitably used in the cover of the present invention is not limited as long as the Young's modulus (E), the shear modulus (G) and E/G are within the above ranges. Preferred are vulcanized rubber, thermosetting resin, thermoplastic elastomers and the like. The cover materials are preferably other than balata (transpolyisoprene).

The rubber, which is obtained from a rubber composition comprising a base rubber and crosslinking agent, may be the rubber composition used for the solid core described above. The base rubber is not limited as long as it is generally crosslinkable using sulfur, peroxide, crosslinking agent for resin and the like. Preferred are polybutadiene rubber and polyisoprene rubber, which have high resilience, because they impart the desired hardness and rebound characteristics to the resulting golf ball. As the crosslinking agent, sulfur, peroxide, crosslinking agent for resin and the like can be used, but preferred are a metal salt of α,β-unsaturated carboxylic acid (such as acrylic acid, methacrylic acid, etc.) or a functional monomer such as trimethylolpropane trimethacrylate, together with peroxides as an initiator. Since the core is formed from a rubber composition as described above, the adhesion between the core and the cover is excellent when the rubber composition is used for the cover.

The thermosetting resin is not limited as long as chemical reaction is thermally carried out to form a three-dimensional network structure, but includes urethane resin, epoxy resin, phenol resin an the like. Preferred is a polyurethane resin (one-component type or two-component type). When the thermosetting resin is used for the cover, it is crosslinked to form a three-dimensional network structure as described above. Therefore it is preferable that the resulting cover has excellent cover strength.

The thermoplastic elastomer is not limited as long as it is composed of soft segments having rubber elasticity and hard segments (such as a frozen phase or crystalline phase), which restrain plastic deformation, but include polystyrene thermoplastic elastomer, polyamide thermoplastic elastomer, polyester thermoplastic elastomer, polyolefin thermoplastic elastomer, polyurethane thermoplastic elastomer and the like. Preferred are polystyrene thermoplastic elastomers, polyester thermoplastic elastomers and polyurethane thermoplastic elastomers, because the frozen phase or crystalline phase as the hard segments thereof has a large chemical bond strength.

The polymer components for the cover composition may be comprised as a main component, and the amount of the polymer components is not less than 50% by weight, preferably not less than 70% by weight, more preferably not less than 90% by weight, based on the cover composition. The polymer component for the cover composition may be used alone or in combination.

The cover composition used in the present invention may optionally contain fillers (such as barium sulfate, etc.), pigments (such as titanium dioxide, etc.) and the other additives such as dispersant, an antioxidant, a UV absorber, a photostabilizer and a fluorescent agent or a fluorescent brightener, etc., in addition to the polymer component, as long as the addition of the additives does not cause a deterioration in the desired performance of the golf ball cover.

It is desired that the cover of the golf ball of the present invention have a thickness of 0.5 to 4.0 mm, preferably 0.8 to 3.0 mm. When the thickness is smaller than 0.5 mm, the strength is low, and the durability is degraded. On the other hand, when the thickness is larger than 4.0 mm, the volume content of the cover is large, and the rebound characteristics are degraded.

A method of covering on the core with the cover is not specifically limited, but may be a conventional method. For example, there can be used a method comprising molding the cover composition into a semi-spherical half-shell in advance, covering the core with the two half-shells, followed by press molding, or a method comprising injection molding the cover composition directly on the core, which is covered with the core, to cover it. However, the method has different steps depending on whether using the rubber composition and thermosetting resin, or the thermoplastic elastomer, as the cover composition.

In the injection molding, when the thermoplastic elastomer is used, it is injected in a flowable state by heating, followed by cooling, and then pulled out in a solidified state. On the other hand, when the rubber composition or the thermosetting resin is used, it is injected in a flowable state by heating at the temperature where the crosslinking (cure) has not yet started, such as at 80 to 120° C., followed by heating to the curing temperature thereof, and then pulled out after completing the cure (for example, at 140 to 180° C. for 15 to 60 minutes).

In the step of molding the cover composition into a semi-spherical half-shell in press molding, when the thermoplastic elastomer is used, it is injected in a flowable state by heating, followed by cooling, and then pulled out in a solidified state as described in the injection molding. On the other hand, when a rubber composition or a thermosetting resin is used, it is injected in a flowable state by heating at a temperature where the crosslinking (cure) has not yet started, such as 80 to 120° C., followed by heating to the curing temperature thereof, and then pulled out after completing the cure (for example, at 140 to 180° C. for 15 to 60 minutes).

At the time of molding the cover, many depressions called "dimples" may be optionally formed on the surface of the golf ball. Furthermore, paint finishing or making with a stamp may be optionally provided after the cover is molded for commercial purposes. The golf ball of the present invention is formed, so that it has a diameter of not less than 42.67 mm (preferably 42.70 to 43.20 mm) and a weight of not more than 45.93 g, according to USGA rules.

EXAMPLES

The following Examples and Comparative Examples further illustrate the present invention in detail but are not to be construed to limit the scope of the present invention.

Production of Core

The rubber composition for the core having the formulation shown in Table 1 was mixed, and then vulcanized by press-molding at 160° C. for 30 minutes in the mold to obtain spherical core having a diameter of 38.4 mm.

TABLE 1

| Core composition | Amount (parts by weight) |
|---|---|
| BR01 *1 | 100 |
| Zinc acrylate | 25 |
| Zinc oxide | 21 |
| Dicumyl peroxide | 1.0 |

*1: High-cis polybutadiene (trade name "BR01") available from JSR Co., Ltd.

Preparation of Cover Compositions (i) Rubber Composition

The rubber composition having the formulation shown in Table 2 was mixed to prepare cover compositions A to F, N and P.

TABLE 2

(parts by weight)

| Cover composition | A | B | C | D | E | F | N | P |
|---|---|---|---|---|---|---|---|---|
| BR01*1 | 100 | 100 | 100 | 100 | 100 | 100 | 100 | 100 |
| Sunceller SR*2 | 10 | 25 | 30 | 35 | 37 | 40 | 5 | 50 |

TABLE 2-continued (parts by weight)

| Cover composition | A | B | C | D | E | F | N | P |
|---|---|---|---|---|---|---|---|---|
| Zinc oxide*3 | 27 | 21 | 19 | 18 | 17 | 16 | 28 | 12 |
| DCP*4 | 1.0 | 1.0 | 1.0 | 1.0 | 1.0 | 1.0 | 1.0 | 1.0 |

*1 High-cis polybutadiene (trade name "BR01") available from JSR Co., Ltd.
*2 Zinc acrylate (trade name "Sunceller SR") available from Asada Chemical Co., Ltd.
*3 Zinc oxide (trade name "Aenka No. 1") available from Toho Aen Co., Ltd.
*4 Dicumyl peroxide (trade name "DCP") available from Nippon Yushi Co., Ltd.

(ii) Thermosetting Resin (a) Urethane Resin Composition

The urethane resin composition having the formulation shown in Table 3 was mixed to prepare cover compositions G and Q. The urethane resin composition is formed by mixing liquid A mainly comprising MOCA and Sumifen with liquid B, which is PPG/TDI prepolymer, at the ratio shown in the same Table.

(b) Epoxy Resin Composition

The epoxy resin composition having the formulation shown in Table 3 was mixed to prepare cover composition H.

(iii) Thermoplastic Elastomer

The thermoplastic elastomer having the formulation shown in Table 3 were used as cover compositions I to K.

(iv) Other Resin (Thermoplastic Resin)

(a) Ionomer Resin

The formulation materials showed in Table 3 were mixed using a kneading type twin-screw extruder to prepare pelletized cover compositions L and M. The extrusion condition was, a screw diameter of 45 mm, a screw speed of 200 rpm, a screw L/D of 35, and a cylinder temperature of 210° C.

(b) Polyethylene Resin

The polyethylene resin having the formulation shown in Table 3 was used as cover composition R.

TABLE 3

(parts by weight)

| Cover composition | G | H | I | J | K | L | M | Q | R |
|---|---|---|---|---|---|---|---|---|---|
| DER 331J*5 | — | 100 | — | — | — | — | — | — | — |
| Dicyandiamide (DICY) | — | 5 | — | — | — | — | — | — | — |
| Omicure P94*6 | — | 2 | — | — | — | — | — | — | — |
| AR790N*7 | — | — | 100 | — | — | — | — | — | — |
| Hytrel 4047*8 | — | — | — | 100 | — | — | — | — | — |
| ET195*9 | — | — | — | — | 100 | — | — | — | — |
| Hi-milan 1605*10 | — | — | — | — | — | 50 | 40 | — | — |
| Hi-milan 1706*11 | — | — | — | — | — | 50 | 40 | — | — |
| SA420*12 | — | — | — | — | — | — | 20 | — | — |
| Sumikasen GZ802*13 | — | — | — | — | — | — | — | — | 100 |
| MOCA*14 | 36 | — | — | — | — | — | — | 36 | — |
| Sumifen 3600*15 | 64 | — | — | — | — | — | — | — | — |
| Sumifen 3086*16 | — | — | — | — | — | — | — | 61 | — |
| Sumifen 0487*17 | — | — | — | — | — | — | — | 3 | — |
| PPG/TDI prepolymer*18 | 100 | — | — | — | — | — | — | 125 | — |
| Titanium dioxide | — | — | — | — | — | 2 | 2 | — | — |

*5 DER 331J (trade name), bisphenol A type epoxy resin, manufactured by ACI JAPAN Co., Ltd.
*6 Omicure P94 (trade name), curing agent, manufactured by ACI JAPAN Co., Ltd.
*7 AR790N (trade name), SEBS (Styrene-ethylene-butadiene-styrene copolymer), manufactured by Aron Chemical Industries Co., Ltd.
*8 Hytrel 4047 (trade name), thermoplastic polyester elastomer, commercially available from Toray-Do Pont Co., Ltd.
*9 Elastoran ET195 (trade name), thermoplastic polyurethane elastomer, commercially available from Takeda Verdishe Co., Ltd.
*10 Hi-milan 1605 (trade name), ethylene-methacrylic acid copolymer ionomer resin obtained by neutralizing with sodium ion, manufactured by Mitsui Du Pont Polychemical Co., Ltd.
*11 Hi-milan 1706 (trade name), ethylene-methacrylic acid copolymer ionomer resin obtained by neutralizing with zinc ion, manufactured by Mitsui Du Pont Polychemical Co., Ltd.
*12 SA420 (trade name), saponified ethylene ethyl acrylate, manufactured by Mitsui Du Pont Polychemical Co., Ltd.
*13 Sumikasen GZ802 (trade name), polyethylene resin, manufactured by Sumitomo Chemical Co., Ltd.
*14 3,3'-dichrolo-4,4'-diamino diphenyl methane, manufactured by Sumitomo Bayer Urethane Co., Ltd.
*15 Sumifen 3600 (trade name), polyurethane prepolymer, manufactured by Sumitomo Bayer Urethane Co., Ltd.
*16 Sumifen 3600 (trade name), polyurethane prepolymer, manufactured by Sumitomo Bayer Urethane Co., Ltd.
*17 Sumifen 0487 (trade name), polyurethane prepolymer, manufactured by Sumitomo Bayer Urethane Co., Ltd.
*18 Polypropylene glycol (PPG)/tolylene diisocyanate (TDI) prepolymer Examples 1 to 6 and Comparative Examples 3 to 4

The cover compositions having the formulation shown in Tables 4 and 5 (Examples), and Table 6 (Comparative Examples) were press molded into a semi-spherical half-shell at 120° C. for 1 minute. The core obtained as described above, which was held at the center point of a mold, was covered with the two half-shells, followed by press molding in the mold with dimples at 160° C. for 20 minutes. Then, deflashing, surface pretreatment for painting, paint and the like, which are generally done on the surface of a golf ball, were conducted on the surface to produce a golf ball having a weight of 45.5 g and a diameter of 43.0 mm. With respect to the resulting golf balls, the Young's modulus (E), the shear modulus (G) and the flyer resistance were measured or evaluated, and the ratio (E/G) was calculated. The results are shown in the same Tables. The test methods are described later.

Examples 7 to 8 and Comparative Example 5

The cover compositions having the formulation shown in Table 5 (Examples), and Table 6 (Comparative Examples) were press molded into a semi-spherical half-shell at 120° C. for 10 minutes. The core obtained as described above, which was held at the center point of a mold, was covered with the two half-shells, followed by press molding in the mold with dimples at 120° C. for 1 hour. Then, deflashing, surface pretreatment for painting, paint and the like, which are generally done on the surface of a golf ball, were conducted on the surface to produce a golf ball having a weight of 45.5 g and a diameter of 43.0 mm. With respect to the resulting golf balls, the Young's modulus (E), the shear modulus (G) and the flyer resistance were measured or evaluated, and the ratio (E/G) was calculated. The results are shown in the same Tables. The test methods are described later.

Examples 9 to 11 and Comparative Examples 1, 2 and 6

The cover compositions having the formulation shown in Table 5 (Examples) and Table 6 (Comparative Examples) were covered on the core obtained as described above by injection molding. Then, deflashing, surface pretreatment for painting, paint and the like, which are generally done on the surface of a golf ball, were conducted on the surface to produce a golf ball having a weight of 45.5 g and a diameter of 43.0 mm. With respect to the resulting golf balls, the Young's modulus (E), the shear modulus (G) and the flyer resistance were measured or evaluated, and the ratio (E/G) was calculated. The results are shown in the same Tables. The test methods are as follows.

(Test Method)

(1) Young's modulus (E) and shear modulus (G)

The Young's modulus (E) and shear modulus (G) were measured using a viscoelastic spectrometer DVA remodeled type, manufactured by Shimadzu Co. at the conditions described as follows.

(i) Young's Modulus (E)

Sample size: 4 mm(width)×20 mm(length)×2 mm(thickness)

Deformation mode: simple stretching (in the direction of the length)

Initial strain: 1% (0.2 mm)

Vibrational amplitude: 0.25% (0.05 mm)

Frequency: 10 Hz

Temperature: 23° C.

(ii) Shear Modulus (G)

Sample size: 4 mm(width)×6 mm(length)×2 mm(thickness)×2 pieces

Deformation mode: simple shearing

Vibrational amplitude: 0.25% (0.015 mm)

Frequency: 10 Hz

Temperature: 23° C.

(2) Flyer Resistance

At approach shot using a pitching wedge, the spin amount (PI) when normally hit, and the spin amount ($P_2$) when hit from a rough were measured, and the flyer resistance was determined by calculating the ratio ($P_2/P_1 \times 100$). When the value is smaller, the golf ball is more easy to occur the flyer. On the other hand, when the value is larger, the golf ball is more difficult to occur. The measurement was conducted by 5 high-level golfers according to practical hitting test, and the average is shown as the result of the golf ball.

(Test Results)

TABLE 4

| Example No. | 1 | 2 | 3 | 4 | 5 | 6 |
|---|---|---|---|---|---|---|
| (Cover) | | | | | | |
| Cover composition | A | B | C | D | E | F |
| Young's modulus E (MPa) | 11.0 | 56.1 | 199 | 253 | 265 | 286.7 |
| Shear modulus G (MPa) | 4.07 | 19.2 | 68.0 | 84.5 | 89.0 | 98.2 |
| Ratio (E/G) (Golf ball) | 2.70 | 2.92 | 2.93 | 2.99 | 2.98 | 2.92 |
| Flyer resistance | 100 | 130 | 145 | 125 | 110 | 105 |

TABLE 5

| Example No. | 7 | 8 | 9 | 10 | 11 |
|---|---|---|---|---|---|
| (Cover) | | | | | |
| Cover composition | G | H | I | J | K |
| Young's modulus E (MPa) | 85.5 | 71.4 | 135 | 45.6 | 175 |
| Shear modulus G (MPa) | 29.0 | 24.4 | 48.2 | 19.0 | 63.1 |
| Ratio (E/G) (Golf ball) | 2.95 | 2.93 | 2.80 | 2.40 | 2.74 |
| Flyer resistance | 133 | 115 | 185 | 135 | 163 |

TABLE 6

| Comparative Example No. | 1 | 2 | 3 | 4 | 5 | 6 |
|---|---|---|---|---|---|---|
| (Cover) | | | | | | |
| Cover composition | L | M | N | P | Q | R |
| Young's modulus E (MPa) | 318 | 252 | 8.5 | 660 | 7.0 | 282 |

TABLE 6-continued

| Comparative Example No. | 1 | 2 | 3 | 4 | 5 | 6 |
|---|---|---|---|---|---|---|
| Shear modulus G (MPa) | 137 | 106 | 3.63 | 293 | 3.04 | 122 |
| Ratio (E/G) (Golf ball) | 2.32 | 2.38 | 2.34 | 2.25 | 2.30 | 2.31 |
| Flyer resistance | 78 | 83 | 96 | 97 | 77 | 20 |

As is apparent from the results of Tables 4 to 6, the golf balls of the present invention of Examples 1 to 11, which adjust the Young's modulus (E), the shear modulus (G) and the ratio (E/G) of the cover to specified ranges, have excellent flyer resistance, when compared with the golf balls of Comparative Examples 1 to 6.

On the other hand, in the golf balls of Comparative Examples 1 and 2, the shear modulus of the cover is large, and the spin amount is small. In addition, the value of E/G is small, and the flyer resistance is poor. In the golf ball of Comparative Example 3, the Young's modulus of the cover is small, and the rebound characteristics and the flyer resistance are degraded. In addition, the value of E/G is small, and the flyer resistance is poor.

In the golf ball of Comparative Example 4, the shear modulus is large and the Young's modulus is large, and the spin amount is small. In addition, the value of E/G is small, and the flyer resistance is poor. In the golf ball of Comparative Example 5, the Young's modulus of the cover is small, and the rebound characteristics and the flyer resistance are degraded. In addition, the value of E/G is small, and the flyer resistance is poor. In the golf ball of Comparative Example 6, the shear modulus of the cover is large, and the spin amount is small. In addition, the value of E/G is small, and the flyer resistance is poor.

What is claimed is:

1. A golf ball comprising a core and a cover covering the core, wherein the cover has a shear modulus (G) of 3 to 100 MPa, a Young's modulus (E) of 9 to 400 MPa, and a ratio (E/G) of 2.4 to 3.0.

2. The golf ball according to claim 1, wherein the cover has a shear modulus (G) of 20 to 90 MPa, a Young's modulus (E) of 40 to 270 MPa, and a ratio (E/G) of 2.7 to 3.0.

3. The golf ball according to claim 2, wherein the cover is formed from a rubber composition.

4. The golf ball according to claim 2, wherein the cover comprises a thermoplastic elastomer as a main component.

5. The golf ball according to claim 2, wherein the cover is formed from a thermosetting resin composition.

6. The golf ball according to claim 1, wherein the cover is formed from a rubber composition.

7. The golf ball according to claim 1, wherein the cover comprises a thermoplastic elastomer as a main component.

8. The golf ball according to claim 7, wherein the thermoplastic elastomer is a polyurethane thermoplastic elastomer.

9. The golf ball according to claim 7, wherein the thermoplastic elastomer is styrene-ethylene-butadiene-styrene copolymer.

10. The golf ball according to claim 7, wherein the thermoplastic elastomer is a polyester thermoplastic elastomer.

11. The golf ball according to claim 1, wherein the cover is formed from a rubber composition.

12. The golf ball according to claim 11, wherein the thermosetting resin is a polyurethane resin.

13. The golf ball according to claim 1, wherein the ratio (E/G) is 2.7 to 3.0.

14. The golf ball according to claim 1, wherein the ratio (E/G) is 2.8 to 3.0.

15. The golf ball according to claim 1, wherein the ratio (E/G) is 2.9 to 3.0.

16. The golf ball according to claim 1, wherein the young's modulus (E) is 20 to 300 MPa.

17. The golf ball according to claim 1, wherein the young's modulus (E) is 40 to 270 MPa.

18. The golf ball according to claim 1, wherein the shear modulus (G) is 20 to 90 MPa.

19. The golf ball according to claim 1, wherein the shear modulus (G) is 40 to 85 MPa.

20. The golf ball according to claim 1, wherein the cover comprises a polyurethane thermoplastic elastomer as a main component and has a ratio (E/G) of 2.7 to 3.0.

21. The golf ball according to claim 1, wherein the cover comprises styrene-ethylene-butadiene-styrene copolymer as a main component and has a ratio (E/G) of 2.7 to 3.0.

22. The golf ball according to claim 1, wherein the cover comprises a thermosetting polyurethane resin as a main component and has a ratio (E/G) of 2.7 to 3.0.

23. The golf ball according to claim 1, wherein the cover comprises a thermosetting polyurethane resin as a main component and has a ratio (E/G) of 2.9 to 3.0.

24. The golf ball according to claim 1, wherein the cover comprises a thermosetting polyurethane resin as a main component and has a young's modulus (E) of 20 to 300, a shear modulus (G) of 20 to 100 and a ratio (E/G) of 2.7 to 3.0.

25. The golf ball according to claim 1, wherein the cover comprises a thermosetting polyurethane resin as a main component and has a young's modulus (E) of 20 to 27 a shear modulus (G) of 20 to 100 and a ratio (E/G) of 2.7 to 3.0.

* * * * *